US012281870B1

(12) United States Patent
Leeds et al.

(10) Patent No.: US 12,281,870 B1
(45) Date of Patent: Apr. 22, 2025

(54) BOWS FOR BOWHUNTING AND ARCHERY

(71) Applicants: Brian K. Leeds, Leeds Point, NJ (US); Erik R. Johnson, Millville, NJ (US)

(72) Inventors: Brian K. Leeds, Leeds Point, NJ (US); Erik R. Johnson, Millville, NJ (US)

( * ) Notice: Subject to any disclaimer, the term of this patent is extended or adjusted under 35 U.S.C. 154(b) by 169 days.

(21) Appl. No.: 17/658,887

(22) Filed: Apr. 12, 2022

(51) Int. Cl.
*F41B 5/14* (2006.01)

(52) U.S. Cl.
CPC ..... *F41B 5/1426* (2013.01)

(58) Field of Classification Search
CPC .. F41B 5/0031; F41B 5/10; F41B 5/14; F41B 5/1426
USPC ..... 124/88, 89
See application file for complete search history.

(56) References Cited

U.S. PATENT DOCUMENTS 3,407,799 A * 10/1968 Bennett ..... F41B 5/0005 123/47 R
3,412,725 A * 11/1968 Hoyt, Jr. ..... F41B 5/1426 124/84
3,416,508 A * 12/1968 Thompson ..... F41B 5/0031 124/44.5
3,513,820 A * 5/1970 Thompson ..... F41B 5/0073 124/24.1
3,538,902 A * 11/1970 Fowkes ..... F41B 5/0031 124/88
3,599,621 A * 8/1971 Scrobell ..... F41B 5/0031 124/90
3,814,074 A * 6/1974 Wood ..... F41B 5/0005 124/88
4,124,014 A * 11/1978 Darlington ..... F41B 5/14 124/88
4,175,536 A * 11/1979 Carella ..... F41B 5/14 124/88
4,252,100 A * 2/1981 Rickard ..... F41B 5/00 124/88
4,457,287 A * 7/1984 Babington ..... F41B 5/10 124/88
4,966,124 A * 10/1990 Burling ..... F41B 5/14 124/88
5,081,979 A * 1/1992 Burling ..... F41B 5/14 124/88
5,469,834 A * 11/1995 Higgins ..... F41B 5/14 124/88
5,595,168 A * 1/1997 Martin ..... F41B 5/1426 124/88
5,651,354 A * 7/1997 La Haise, Sr. ..... F41B 5/0052 124/88
5,842,460 A * 12/1998 Barber ..... F41B 5/14 124/88
6,988,495 B1 * 1/2006 Van Hoorn ..... F41B 5/14 124/88

(Continued)

*Primary Examiner* — Alexander R Niconovich
(74) *Attorney, Agent, or Firm* — John F. A. Earley, III; Harding, Earley, Follmet & Frailey, P.C.

(57) ABSTRACT

A bow for bowhunting or archery has a bow grip that includes a handle pivotally mounted over the rear surface of the bow at the bow grip creating a pivot point over which the handle pivots at which the different directions of torque exerted on the bow grip by the hand of an archer/bowhunter are focused into one area and straight into the bow, reducing or substantially eliminating the adverse effects of hand torque. Preferably, the location of the pivot point may be adjusted. The bow preferably also is provided with a pair of springs mounted between the handle and the rear surface of the bow for stabilizing the handle.

36 Claims, 9 Drawing Sheets

(56) References Cited

U.S. PATENT DOCUMENTS

| | | | | |
|---|---|---|---|---|
| 7,708,004 | B2 * | 5/2010 | Moss | F41B 5/10 124/88 |
| 8,783,239 | B2 * | 7/2014 | Vyprachticky | F41B 5/1403 124/88 |
| 9,417,027 | B2 * | 8/2016 | Meilak | F41B 5/14 |
| 9,702,656 | B2 * | 7/2017 | Vyprachticky | F41B 5/1403 |
| 10,126,091 | B2 * | 11/2018 | Wendelburg | F41B 5/14 |
| 10,648,760 | B2 * | 5/2020 | Gold | F41B 5/1403 |
| 10,648,761 | B1 * | 5/2020 | Elezar | F41B 5/00 |
| 10,928,155 | B2 * | 2/2021 | Wasilewski | F41B 5/1403 |
| 11,022,399 | B2 * | 6/2021 | Wendelburg | F41B 5/1426 |
| 11,519,687 | B1 * | 12/2022 | Stevens | F41B 5/1403 |
| 2002/0073983 | A1 * | 6/2002 | Etheridge | F41B 5/14 124/88 |
| 2013/0340735 | A1 * | 12/2013 | Emory | F41B 5/1403 124/88 |
| 2014/0366858 | A1 * | 12/2014 | Garver | F41B 5/10 29/428 |
| 2017/0160043 | A1 * | 6/2017 | Potts | F41B 5/148 |

* cited by examiner

BOWS FOR BOWHUNTING AND ARCHERY

FIELD OF THE INVENTION

This invention relates to bowhunting and archery, and more particularly concerns bows for bowhunting and archery.

BACKGROUND OF THE INVENTION

In archery and bowhunting, hand torque is a huge factor affecting accuracy. Hand torque occurs when pressure via the hand of an archer/bowhunter is exerted on the riser of a bow at the bow grip. That pressure may twist the bow when the string is released when shooting an arrow, causing the arrow to hit left or right of the target center. Slightest amounts of hand torque have an effect on accuracy. Even where and how the hand of the archer/bowhunter is placed on the bow grip affects where the forces are applied to the bow grip. Variations to where and how the hand of an archer/bowhunter is placed on the bow grip from shot to shot changes the hand torque from shot to shot, leading to inaccuracy. Inconsistencies of where and how the hand of the archer/bowhunter is placed on the bow grip from shot to shot typically affects consistency and accuracy.

SUMMARY OF THE INVENTION

It is an object of the invention to provide a bow for bowhunting or archery that reduces or substantially eliminates the adverse effects of hand torque.

Still another object of the invention when shooting an arrow with a bow is to reduce or substantially eliminate inaccuracy caused by variations from shot to shot relating to where and how the hand of an archer/bowhunter is placed on the bow grip.

It is another object of the invention to provide a bow for bowhunting or archery that focuses the different directions of torque exerted onto the bow grip by the hand of an archer/bowhunter into one small area and straight into the bow, which allows the bow to naturally find a consistent resting point when drawn to a full draw.

Another object of the invention is to provide a bow for bowhunting or archery that comprises a bow body, the bow body including a riser, the riser having a front surface that faces a target when a user of the bow aims an arrow being shot from the bow at the target, the riser having a rear surface that faces away from a target when a user of a bow aims an arrow being shot from the bow at the target, a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, and means for pivotally mounting the handle onto the bow grip.

These and other objects are provided by the invention, a description of which is set out below.

DETAILED DESCRIPTION

Figure 1:
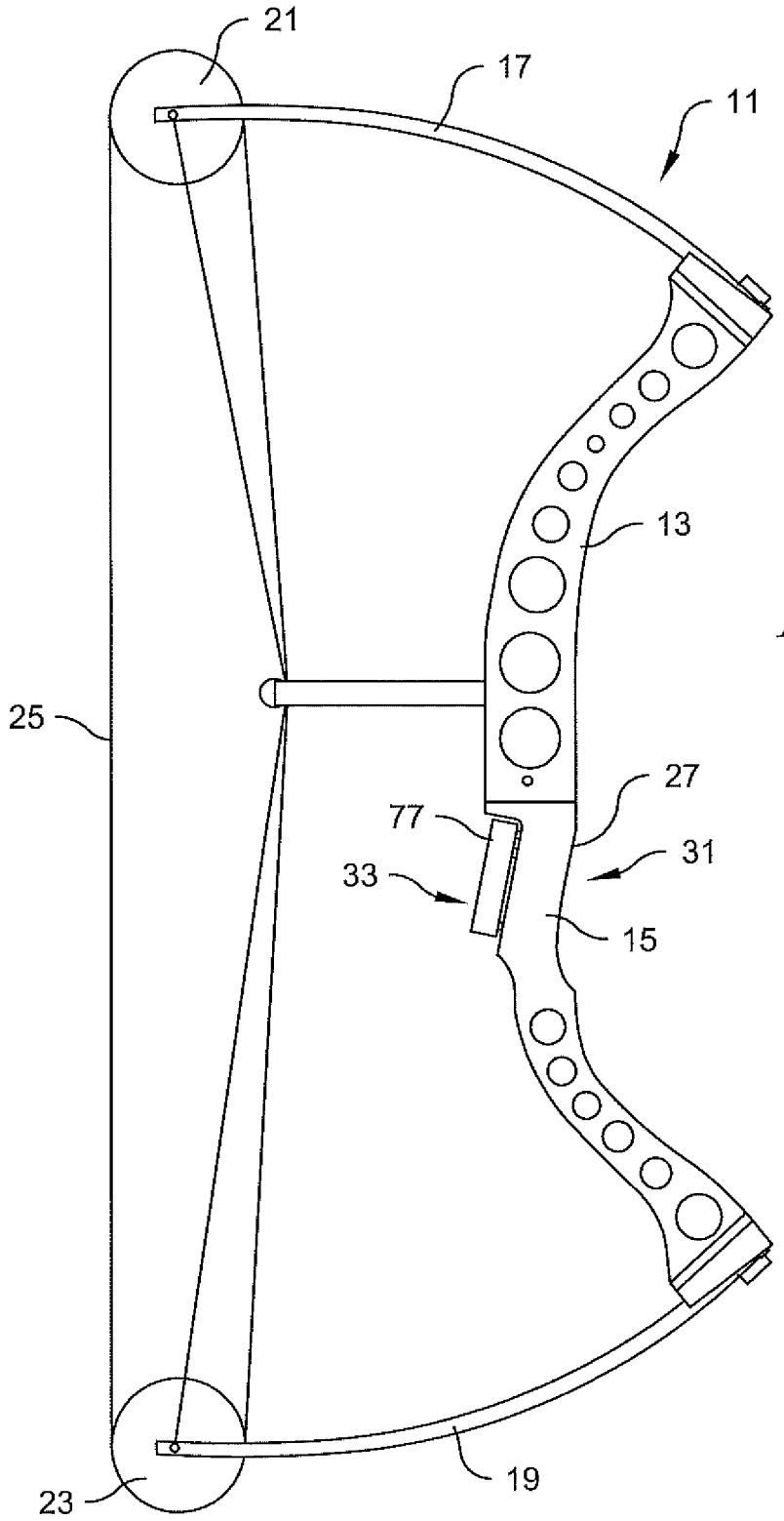
FIG. 1 is a view in side elevation of a preferred embodiment of the inventive bow 11 for bowhunting or archery, constructed in accordance with the invention.

Turning to the drawings, there are shown preferred embodiments of the invention. The invention may, however, be embodied in many different forms, and should not be construed as being limited to the example embodiments described below. The example embodiments are just that—examples. The physical embodiments disclosed herein merely exemplify the invention which may be embodied in other specific structure. The scope of the invention is defined in the patent claims hereof.

Like reference numbers refer to like elements throughout this disclosure (e.g., bow grip 31 is the same or substantially similar to bow grip 131, handle 33 is the same or substantially similar to handle 133, and ball and socket joint 37 is the same or substantially similar to ball and socket joint 137).

Turning to FIGS. 1-8, there is shown a first preferred embodiment of the invention, which comprises a compound bow 11 for bowhunting or archery. The inventive bow 11 comprises a bow body 13 having a riser 15, an upper limb 17 extending from the riser 15, and a lower limb 19 extending from the riser 15. An upper cam 21 is mounted on the end portion of the upper limb 17, a lower cam 23 is mounted on the end portion of the lower limb 19, and a bow string 25 extends between the upper cam 21 and lower cam 23. The riser 15 has a front surface 27 that faces a target when a user of the bow 11 aims an arrow being shot from the bow 11 at the target, and the riser 15 has a rear surface 29 that faces away from a target when a user of the bow 11 aims an arrow being shot from the bow 11 at the target.

The bow 11 is provided with a bow grip 31 for engaging a hand of a bowhunter or an archer when a bowhunter or an archer is shooting an arrow with the bow 11. The bow grip 31 is located along and comprises a portion of the riser 15.

The bow grip 31 includes a handle 33 pivotally mounted thereto such that the handle 33 is pivotally mounted over the rear surface 29 of the riser 15 at the bow grip 31.

The bow 11 also has means 35 for pivotally mounting the handle 33 onto the bow grip 31. Preferably, the means 35 for pivotally mounting the handle 33 onto the bow grip 31 comprises a ball and socket joint 37. The ball and socket joint 37 preferably includes a spherical knob 39 mounted to the bow 11 at the bow grip 31 and extending rearwardly away from the rear surface 29 of the riser 15. The ball and socket joint 37 also preferably includes a spherical socket 41 that is formed in the handle 33 and that receives the spherical knob 39, thereby permitting the handle 33 to pivot on the spherical knob 39. The spherical knob 39 is positioned within the spherical socket 41 and secured in place within the spherical socket 41 using any conventional means for doing so, such as those known from tie rod ends of automotive steering systems using tie rods. Preferably, a locking mechanism and/or retaining collar may be used to keep the spherical knob 39 within the spherical socket 41.

Figure 2:
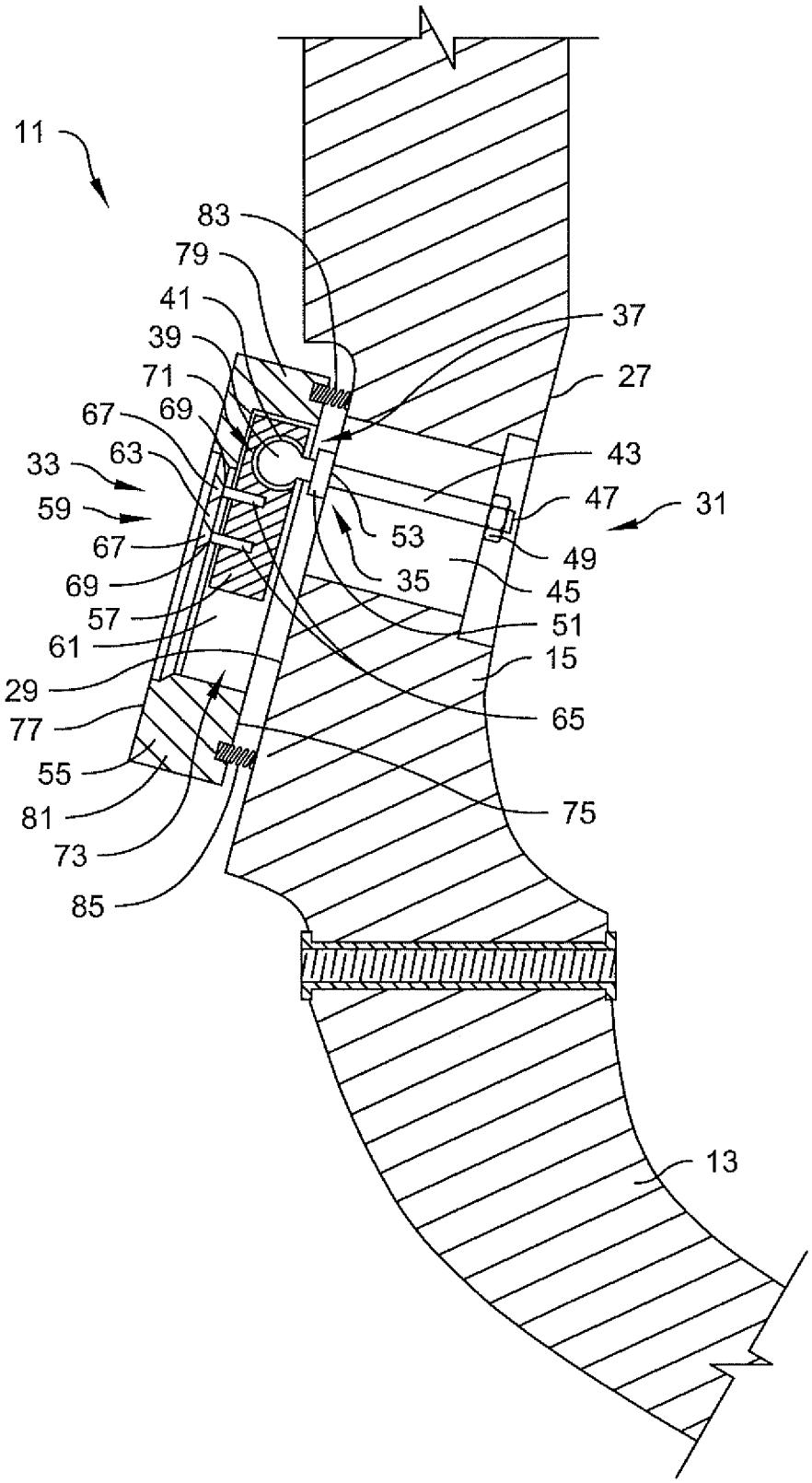
FIG. 2 is a partial view in cross-section of a portion of the bow 11 shown in FIG. 1, illustrating the bow grip 31 of the bow 11.
Figure 3:
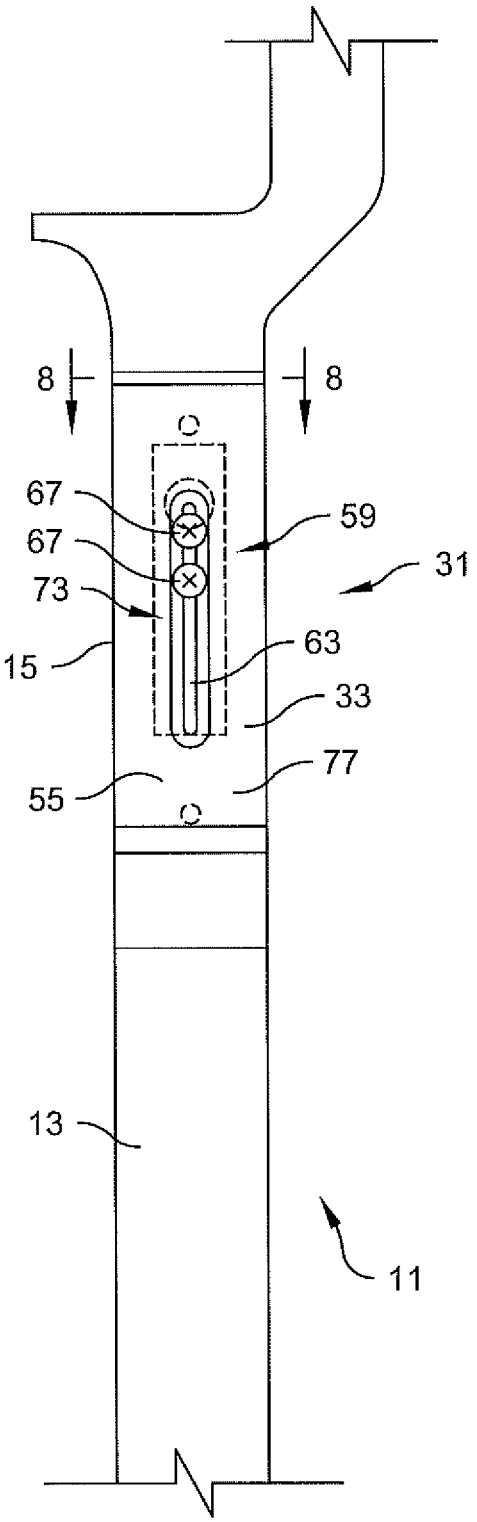
FIG. 3 is a partial view in rear elevation of a portion of the bow 11 shown in FIG. 1, illustrating the handle 33 of the bow grip 31 of the bow 11.
Figure 4:
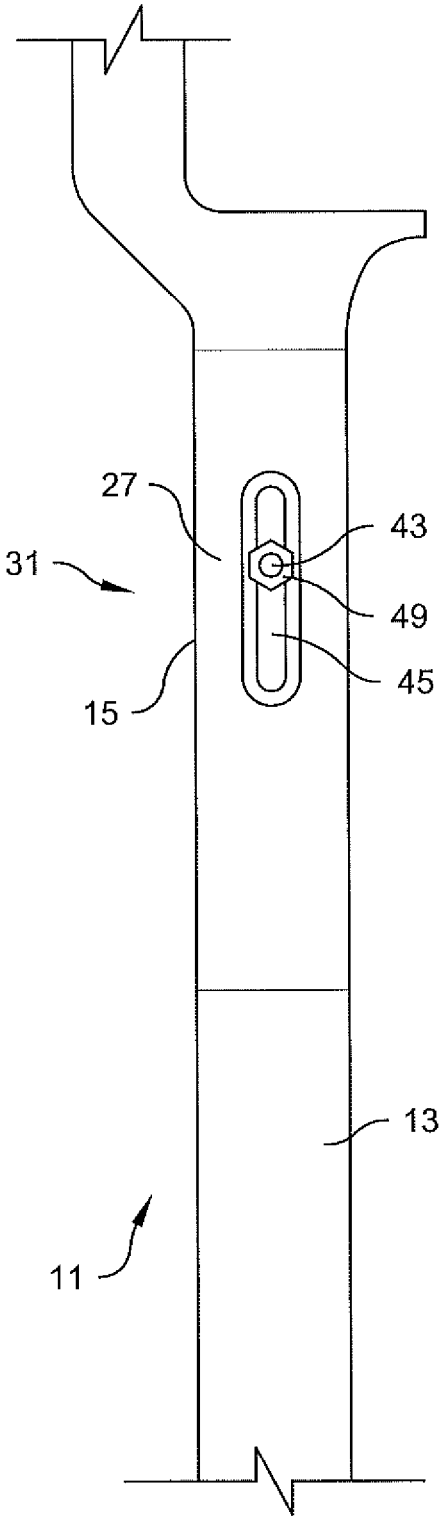
FIG. 4 is a partial view in front elevation of a portion of the bow 11 shown in FIG. 1, illustrating the stud 43 of the ball and socket joint 37 extending through a slot 45 formed in the bow grip 31 and secured in place with a nut 49.
Figure 5:
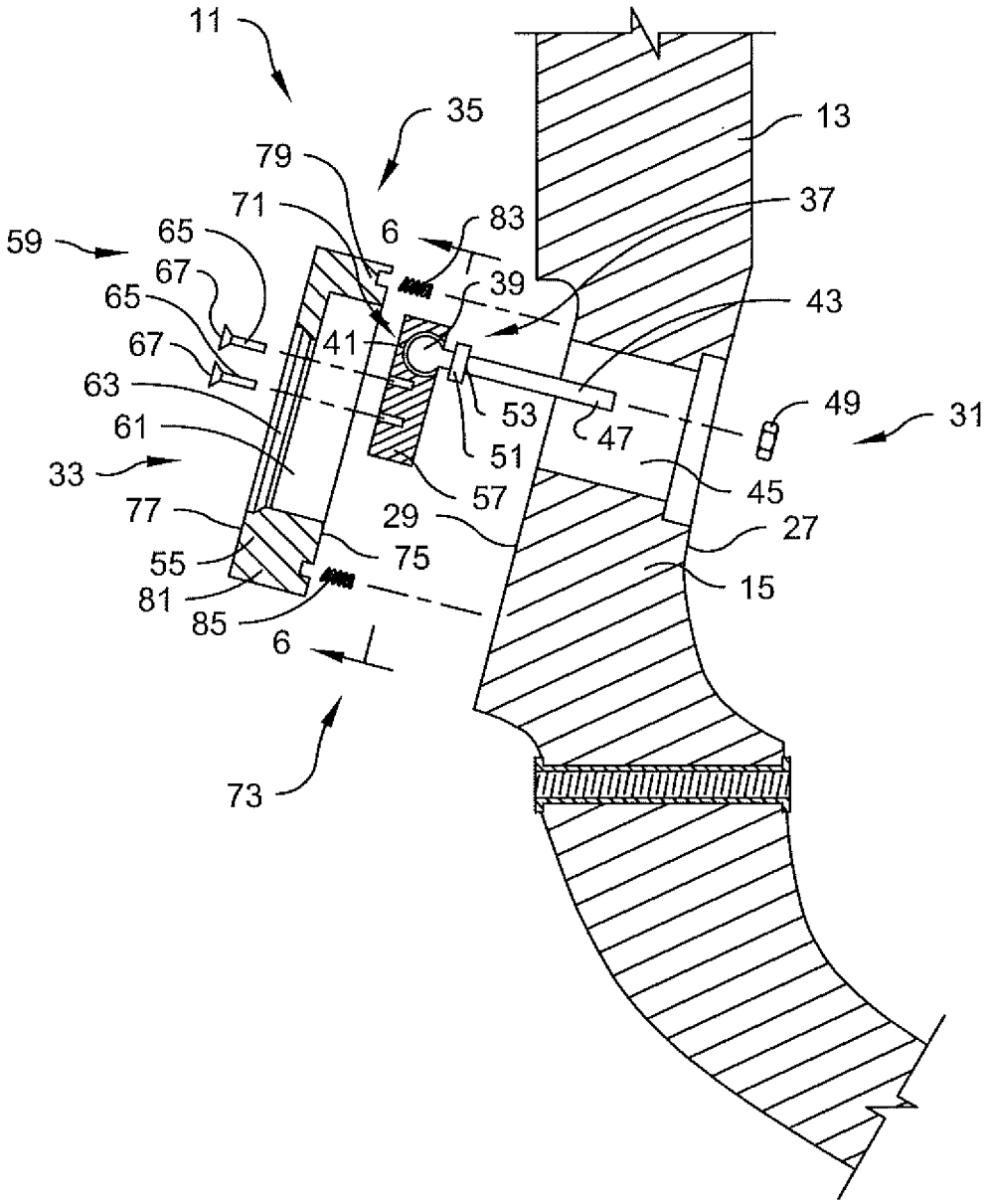
FIG. 5 is an exploded view of the cross-section shown in FIG. 2.
Figure 6:
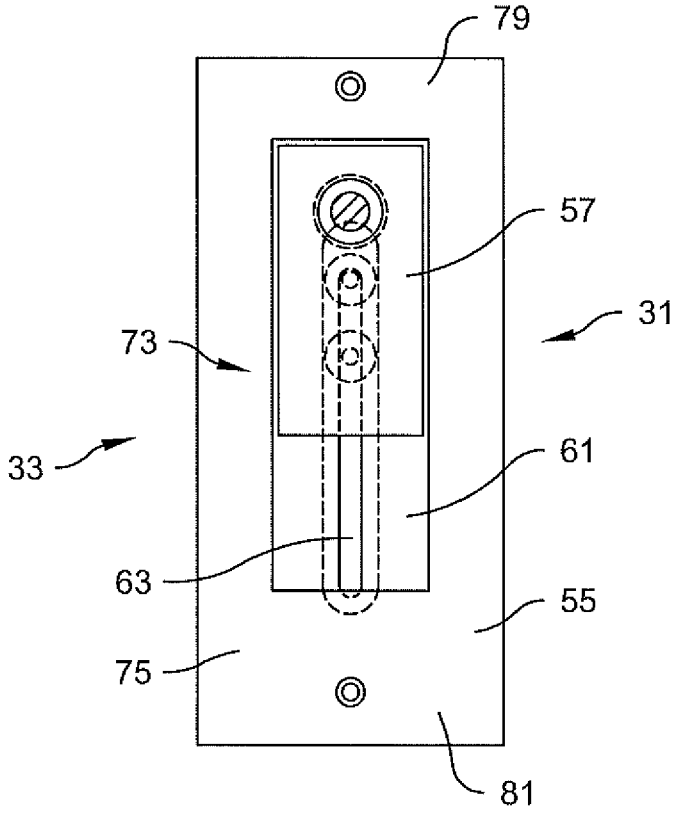
FIG. 6 is a view taken along the lines and arrows 6-6 shown in FIG. 5.
Figure 7:
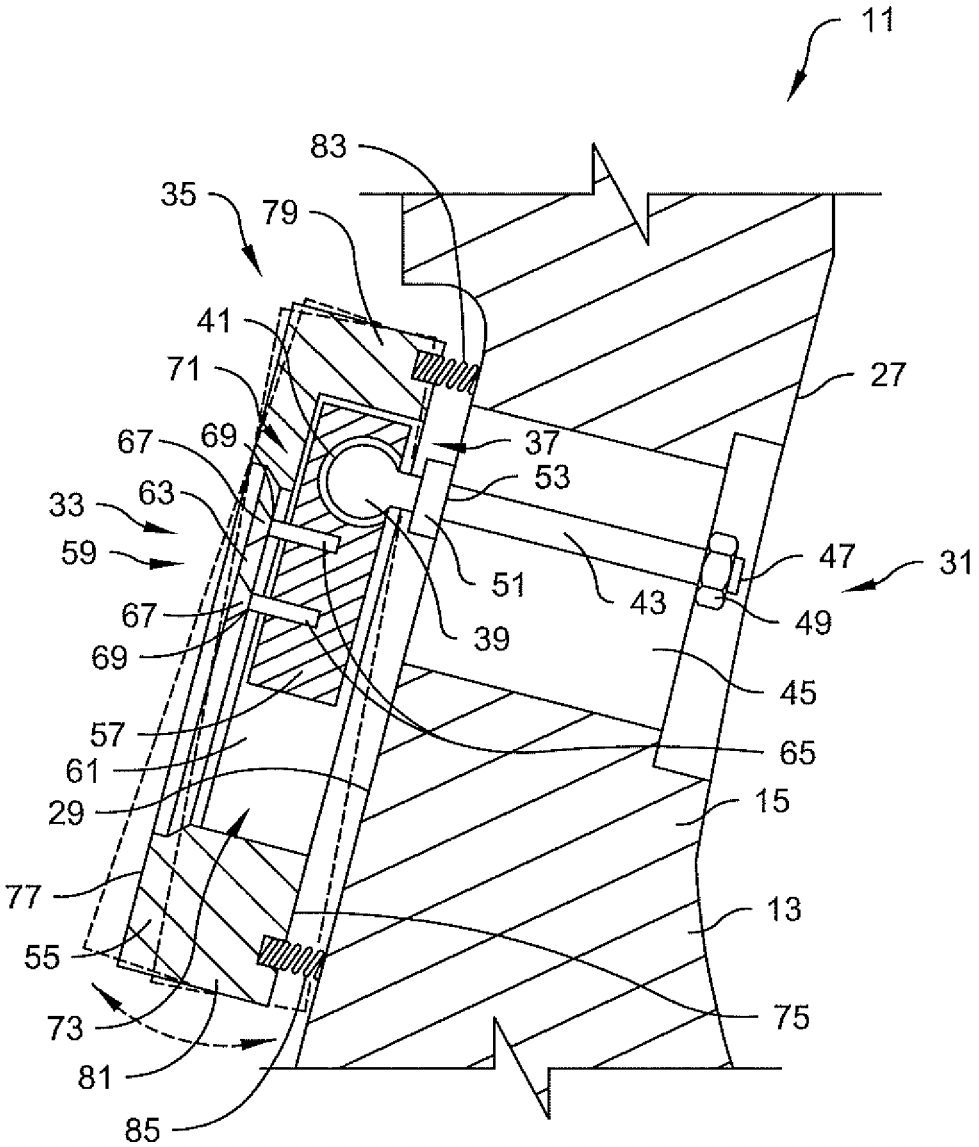
FIG. 7 is a partial view in cross-section of a portion of the bow 11 shown in FIG. 1, illustrating the handle 33 of the bow grip 31 of the bow 11 when the ball and socket joint 37 is positioned at the upper end portion of the handle 33, and illustrating with dashed lines pivotal movement of the handle 33 as the handle 33 pivots on the spherical knob 39 of the ball and socket joint 37.
Figure 7A:
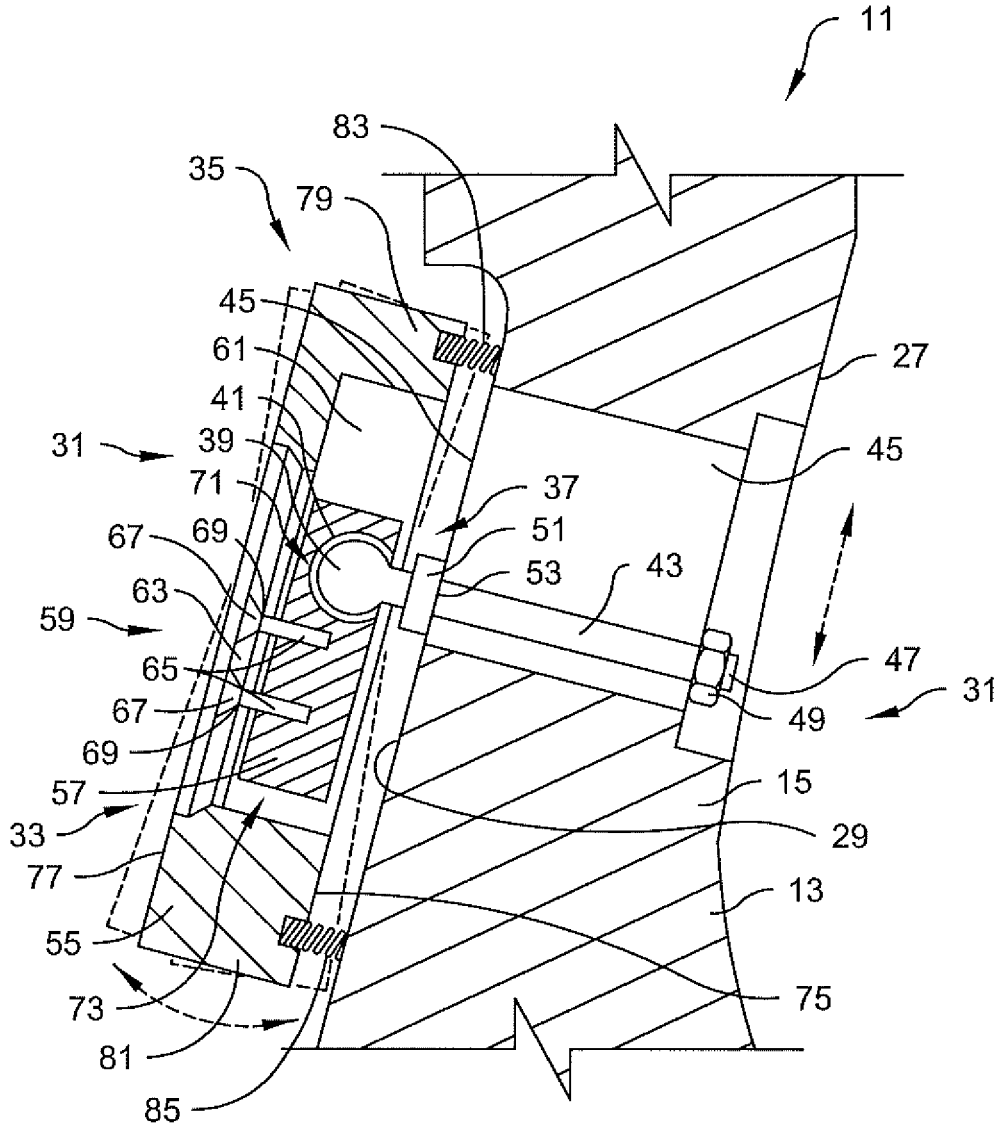
FIG. 7*a* is a partial view in cross-section of a portion of the bow 11 shown in FIG. 1, illustrating the handle 33 of the bow grip 31 of the bow 11 when the ball and socket joint 37 is positioned at a lower portion in the handle 33 than that shown in FIG. 7, and illustrating with dashed lines pivotal movement of the handle 33 as the handle pivots on the spherical knob 39 of the ball and socket joint 37.
Figure 8:
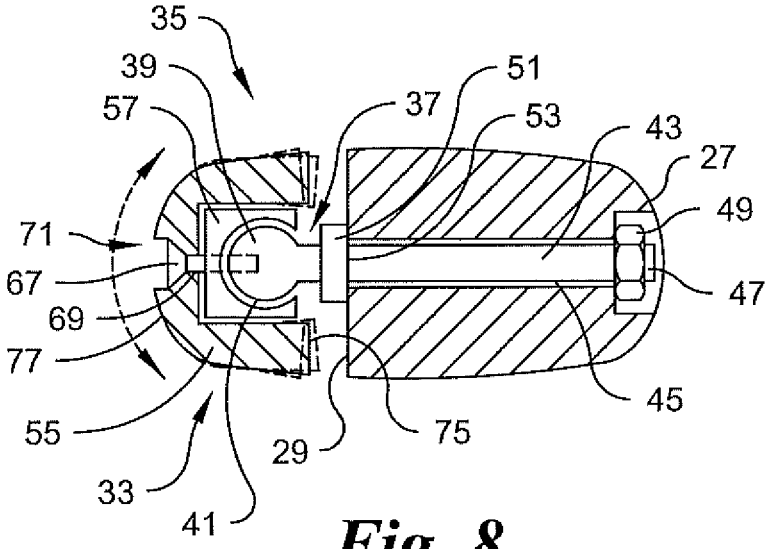
FIG. 8 is a view taken along the lines and arrows 8-8 shown in FIG. 3, and illustrating with dashed lines pivotal movement of the handle 33 as the handle 33 pivots on the spherical knob 39 of the ball and socket joint 37.

Preferably, the ball and socket joint 37 further includes a stud 43 extending from the spherical knob 39. The stud 43 extending from the spherical knob 39 extends through a slot 45 formed in the bow grip 31 that extends from the front surface 27 of the riser 15 at the bow grip 31 to the rear surface 29 of the riser 15 at the bow grip 31. Preferably, the stud 43 has a threaded end portion 47, and a nut 49 sized to be screwed onto threaded end portion 47 of the stud 43 to fix the stud 43 securely in place on the bow grip 31 at a location chosen along the slot 45 when the nut 49 is screwed onto the threaded end portion 47 of the stud 43 and into tight engagement against the front surface 27 of the riser 15 at the bow grip 31. Preferably, as shown in FIGS. 2 and 8, the stud 43 also has a flange 51 at the first end portion 53 of the stud 43, and the flange 51 extends radially outwardly from the center axis of the stud 43. The flange 51 is pulled into tight engagement with the rear surface 29 of the riser 15 at the bow grip 31 when the nut 49 is screwed onto the threaded end portion 47 of the stud 43 and into tight engagement against the front surface 27 of the riser 15 at the bow grip 31, thereby fixing the stud 43 securely in place on the bow grip 31 at a location chosen along the slot 45. Also, preferably, the front surface 27 of the riser 15 surrounding the slot 45 is recessed so that neither the nut 49 nor the end of the threaded end portion 47 of the stud 43 protrude beyond the front surface 27 of the riser 15 surrounding the recessed portion of the front surface 27 of the riser 15.

Preferably, the handle 33 includes a handle body 55, a handle attachment member or socket block 57 into which the spherical socket 41 is formed, and attachment means 59 for attaching the handle body 55 to the handle attachment member 57. The handle body 55 includes a recess 61 formed therein in which and along the handle attachment member 57 may be positioned.

The attachment means 59 includes a slot 63 formed in and extending through the handle body 55, and at least one screw 65 (and preferably two screws 65), each screw 65 having a screwhead 67, and each screw 65 extending through the slot 63 in the handle body 55 and into the handle attachment member 57, with a portion 69 of the handle body 55 along the slot 63 in the handle body 55 being sandwiched between the screwhead 67 of each screw 65 and the handle attachment member 57 to attach the handle body 55 to the handle attachment member 57.

The handle 33 has a pivot point 71 over which the handle 33 pivots, and the pivot point 71 corresponds to where the handle 33 connects to the ball and socket joint 37. The pivot point 71 establishes a single point force-wise at the bow grip 31 via the ball and socket joint 37 where the different directions of torque exerted onto the bow grip 31 by the hand of an archer/bowhunter engaging the handle 33 when shooting an arrow with the bow 11 are focused into one small area and straight into the bow 11, which allows the bow 11 to naturally find a consistent resting point when drawn to a full draw.

Preferably, the bow 11 includes adjustment means 73 for adjusting where the pivot point 71 is located along the bow grip 31, and, preferably, the adjustment means 73 comprises a combination of the recess 61 in the handle body 55, the slot 63 formed in and extending through the handle body 55, and the slot 45 formed in and extending through the riser 15 at the bow grip 31, said combination permitting the ball and socket joint 37 to be positioned at any chosen location along the slot 45 in the bow grip 31 by sliding the handle attachment member 57 along the recess 61 in the handle body 55 while sliding the stud 43 along the slot 45 extending through the bow grip 31, thereby permitting the pivot point 71 of the handle 33 to be moved to any chosen location along the slot 45 in the bow grip 31.

The adjustment means 73 further includes the screw or screws 65 securing the handle attachment member 57 to the handle body 55 by being extended through the slot 63 in the handle body 55 and into the handle attachment member 57 with a portion 69 of the handle body 55 along the slot 63 in the handle body 55 being sandwiched between the screwhead 67 of each screw 65 and the handle attachment member 57 after the handle attachment member 57 has been positioned at a chosen location along the recess 61 in the handle body 55, so as to position the ball and socket joint 37 at any chosen location in the handle body 55 and at the corresponding location along the slot 45 in the bow grip 31, and the nut 49 securely fixing the stud 43 in place to the bow grip 31 along the slot 45 formed in and extending through the riser 15 at the bow grip 31 by being screwed onto the threaded end portion 47 of the stud 43 until the nut 49 is pressing securely against the riser 15 at the front surface 27 of the riser 15 after the stud 43 has been positioned along the slot 45 extending through the bow grip 31 to position the ball and socket joint 37 at a chosen location along the bow grip 31. Accordingly, the location where the pivot point 71 is located along the bow grip 31 of the bow 11 may be adjusted by following the steps of untightening the nut 49 on the threaded end portion 47 of the stud 43 to permit the stud 43 to slide in the slot 45 along the bow grip 31, untightening each screw 65 (or removing each screw 65) to permit the handle attachment member 57 to slide along the recess 61 in the handle body 55, sliding the handle attachment member 57 along the recess 61 in the handle body 55 while sliding the stud 43 in the slot 45 extending through the bow grip 31 along the bow grip 31 until the ball and socket joint 37 is re-positioned from a first location along the bow grip 31 to a second location along the bow grip 31, the second location being where an archer or bowhunter using the bow 11 wishes the pivot point 71 of the handle 33 to be reset, screwing each screw 65 through the slot 63 in the handle body 55 and into the handle attachment member 57 so that a portion 69 of the handle body 55 along the slot 63 in the handle body 55 is sandwiched between the screwhead 67 of each screw 65 and the handle attachment member 57 to fix the spherical socket 41 of the ball and socket joint 37 at the second location along the bow grip 31, and screwing the nut 49 onto the threaded end portion 47 of the stud 43 and into tight engagement against the front surface 27 of the riser 15 at the bow grip 31, thereby pulling a portion of the first end portion 53 of the stud 43 (such as the flange 51) into tight engagement with the rear surface 29 of the riser 15 at the bow grip 31, to fix the stud 43 securely in place on the bow grip 31 along the slot 43 extending through the bow grip 31 and to fix the spherical knob 39 of the ball and socket joint 37 at the second location along the bow grip 31.

The handle 33 has a front side 75 that faces the rear surface 29 of the riser 15, and a rear side 77 that faces away from a target when a user of the bow 11 aims an arrow being shot from the bow 11 at the target. The handle 33 also has an upper end portion 79 and a lower end portion 81.

As illustrated in FIGS. 2, 5, 7, and 7*a*, the bow 11 preferably also includes a first spring 83 mounted between the rear surface 29 of the riser 15 and the front side 75 of the handle 33 at the upper end portion 79 of the handle 33, and a second spring 85 mounted between the rear surface 29 of the riser 15 and the front side 75 of the handle 33 at the lower end portion 81 of the handle 33. The springs 83 and 85 stabilize the handle 33 (such as by tightening any looseness in the handle 33) and aid in vertically stabilizing the bow 11 when the bow string 25 is drawn to keep the bow 11 oriented in a vertical position.

Figure 9:
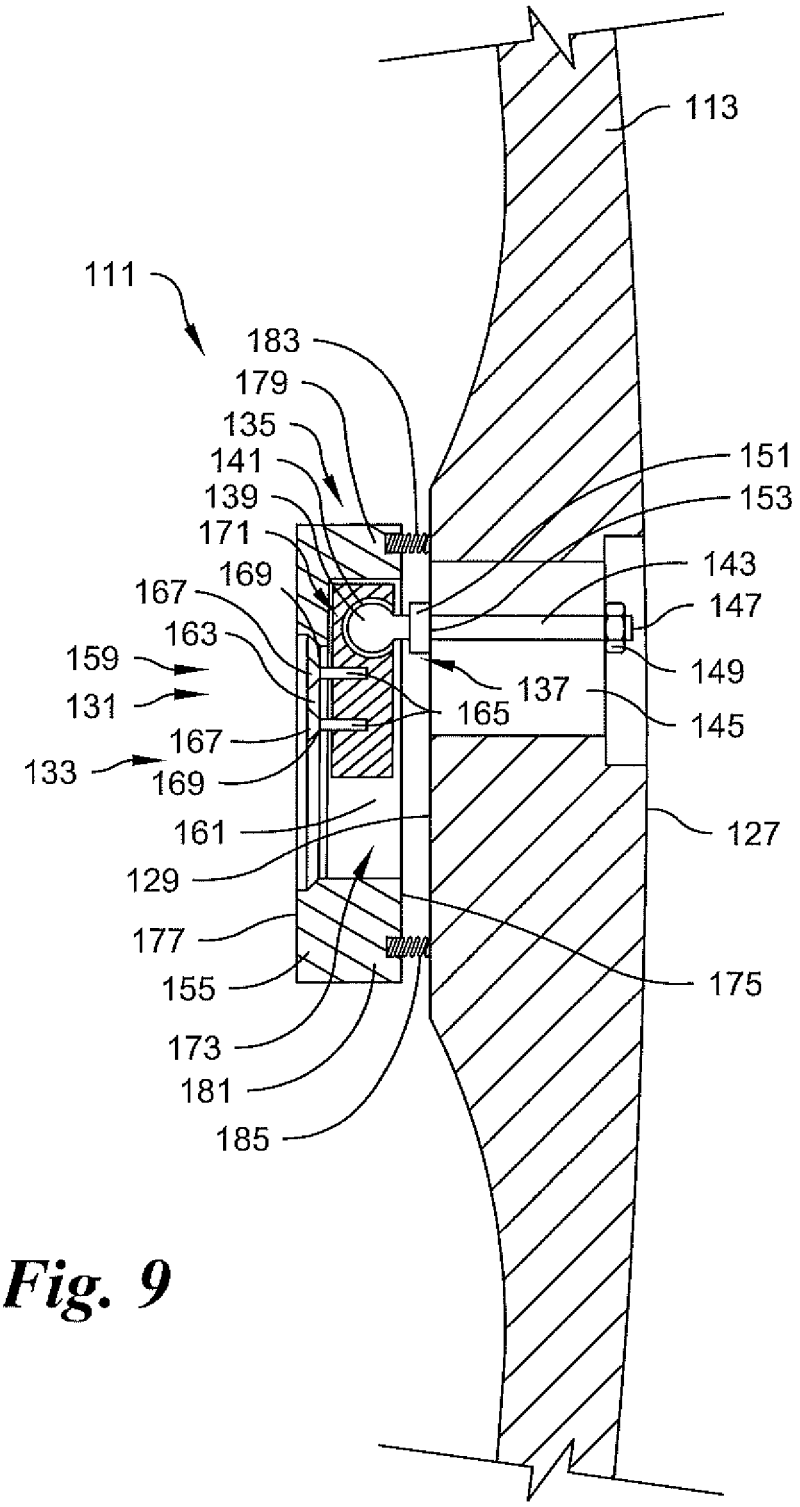
FIG. 9 is a schematic view in cross-section of a portion of other preferred archery/bowhunting bows, such as long bows and recurve bows, constructed in accordance with the invention, in which the bow grip 131 of such bows is illustrated.

Turning now to FIG. 9, other preferred archery/bowhunting bows 111 constructed in accordance with the invention are shown. FIG. 9 is a schematic view in cross-section of a portion of other preferred archery/bowhunting bows 111, such as long bows and recurve bows, in which the bow grip 131 of such bows 111 is illustrated.

Each bow 111 represented in FIG. 9 has a curved bow-like structure or bow body 113 (which may comprise the combination of a riser having an upper limb extending from the riser and a lower limb extending from the riser, with a bow string extending between the ends of the upper limb and the lower limb, or a single piece of material having a bow string extending between its end portions) having a bow grip 131, with the bow grip 131 including a handle 133 pivotally mounted thereto, the handle 133 being pivotally mounted over the rear surface 129 of the curved bow-like structure 113. The spherical knob 139 is positioned within the spherical socket 141 and secured in place within the spherical socket 141 using any conventional manner, such as that known from tie rod ends of automotive steering systems using tie rods. Preferably, a locking mechanism and/or retaining collar may be used to keep the spherical knob 139 within the spherical socket 141.

Each bow 111 has means 135 for pivotally mounting the handle 133 onto the bow grip 131. Like the ball and socket joint 137, the ball and socket joint 137 preferably includes a spherical knob 139 mounted to the bow 111 at the bow grip 131 and extending rearwardly away from the rear surface 129 of the bow body 113. The ball and socket joint 137 also preferably includes a spherical socket 141 that is formed in the handle 133 and that receives the spherical knob 139, thereby permitting the handle 133 to pivot on the spherical knob 139. The spherical knob 139 is positioned within the spherical socket 141 and secured in place within the spherical socket 141 using any conventional means for doing so, such as those known from tie rod ends of automotive steering systems using tie rods. Preferably, a locking mechanism and/or retaining collar may be used to keep the spherical knob 139 within the spherical socket 141.

Preferably, the ball and socket joint 137 further includes a stud 143 extending from the spherical knob 139. The stud 143 extending from the spherical knob 139 extends through a slot 145 formed in the bow grip 131 that extends from the front surface 127 of the bow body 113 at the bow grip 131 to the rear surface 129 of the bow body 113 at the bow grip 131. Preferably, the stud 143 has a threaded end portion 147, and a nut 149 sized to be screwed onto threaded end portion 147 of the stud 143 to fix the stud 143 securely in place on the bow grip 131 at a location chosen along the slot 145 when the nut 149 is screwed onto the threaded end portion 147 of the stud 143 and into tight engagement against the front surface 127 of the bow body 113 at the bow grip 131. Preferably, the stud 143 also has a flange 151 at the first end portion 153 of the stud 143, and the flange 151 extends radially outwardly from the center axis of the stud 143. The flange 151 is pulled into tight engagement with the rear surface 129 of the bow body 113 at the bow grip 131 when the nut 149 is screwed onto the threaded end portion 147 of the stud 143 and into tight engagement against the front surface 127 of the bow body 113 at the bow grip 131, thereby fixing the stud 143 securely in place on the bow grip 131 at a location chosen along the slot 145. Also, preferably, the front surface 127 of the bow body 113 surrounding the slot 145 is recessed so that neither the nut 149 nor the end of the threaded end portion 147 of the stud 143 protrude beyond the front surface 127 of the bow body 113 surrounding the recessed portion of the front surface 127 of the bow body 113.

Preferably, the handle 133 includes a handle body 155, a handle attachment member or socket block 157 into which the spherical socket 141 is formed, and attachment means 159 for attaching the handle body 155 to the handle attachment member 157. The handle body 155 includes a recess 161 formed therein in which and along the handle attachment member 157 may be positioned.

The attachment means 159 includes a slot 163 formed in and extending through the handle body 155, and at least one screw 165 (and preferably two screws 165), each screw 165 having a screwhead 167, and each screw 165 extending through the slot 163 in the handle body 155 and into the handle attachment member 157, with a portion 169 of the handle body 155 along the slot 163 in the handle body 155 being sandwiched between the screwhead 167 of each screw 165 and the handle attachment member 157 to attach the handle body 155 to the handle attachment member 157.

The handle 133 has a pivot point 171 over which the handle 133 pivots, and the pivot point 171 corresponds to where the handle 133 connects to the ball and socket joint 137. The pivot point 171 establishes a single point forcewise at the bow grip 131 via the ball and socket joint 137 where the different directions of torque exerted onto the bow grip 131 by the hand of an archer/bowhunter engaging the handle 133 when shooting an arrow with the bow 111 are focused into one small area and straight into the bow 111, which allows the bow 111 to naturally find a consistent resting point when drawn to a full draw.

Preferably, the bow 111 includes adjustment means 173 for adjusting where the pivot point 171 is located along the bow grip 131, and, preferably, the adjustment means 173 comprises a combination of the recess 161 in the handle body 155, the slot 163 formed in and extending through the handle body 155, and the slot 145 formed in and extending through the bow body 113 at the bow grip 131, said combination permitting the ball and socket joint 137 to be positioned at any chosen location along the slot 145 in the bow grip 131 by sliding the handle attachment member 157 along the recess 161 in the handle body 155 while sliding the stud 143 along the slot 145 extending through the bow grip 131, thereby permitting the pivot point 171 of the handle 133 to be moved to any chosen location along the slot 145 in the bow grip 131.

The adjustment means 173 further includes the screw or screws 165 securing the handle attachment member 157 to the handle body 155 by being extended through the slot 163 in the handle body 155 and into the handle attachment member 157 with a portion 169 of the handle body 155 along the slot 163 in the handle body 155 being sandwiched between the screwhead 167 of each screw 165 and the handle attachment member 157 after the handle attachment member 157 has been positioned at a chosen location along the recess 161 in the handle body 155, so as to position the ball and socket joint 137 at any chosen location in the handle body 155 and at the corresponding location along the slot 145 in the bow grip 131, and the nut 149 securely fixing the stud 143 in place to the bow grip 131 along the slot 145 formed in and extending through the bow body 113 at the bow grip 131 by being screwed onto the threaded end portion 147 of the stud 143 until the nut 149 is pressing securely against the bow body 113 at the front surface 127 of the bow body 113 after the stud 143 has been positioned along the slot 145 extending through the bow grip 131 to position the ball and socket joint 137 at a chosen location along the bow grip 131. Accordingly, the location where the pivot point 171 is located along the bow grip 131 of the bow 111 may be adjusted by following the steps of untightening the nut 149 on the threaded end portion 147 of the stud 143 to permit the stud 143 to slide in the slot 145 along the bow grip 131, untightening each screw 165 (or removing each screw 165) to permit the handle attachment member 157 to slide along the recess 161 in the handle body 155, sliding the handle attachment member 157 along the recess 161 in the handle body 155 while sliding the stud 143 in the slot 145 extending through the bow grip 131 along the bow grip 131 until the ball and socket joint 137 is re-positioned from a first location along the bow grip 131 to a second location along the bow grip 131, the second location being where an archer or bowhunter using the bow 111 wishes the pivot point 171 of the handle 133 to be reset, screwing each screw 165 through the slot 163 in the handle body 155 and into the handle attachment member 157 so that a portion 169 of the handle body 155 along the slot 163 in the handle body 155 is sandwiched between the screwhead 167 of each screw 165 and the handle attachment member 157 to fix the spherical socket 141 of the ball and socket joint 137 at the second location along the bow grip 131, and screwing the nut 149 onto the threaded end portion 147 of the stud 143 and into tight engagement against the front surface 127 of the bow body 113 at the bow grip 131, thereby pulling a portion of the first end portion 153 of the stud 143 (such as the flange 151) at the bow grip 131 into tight engagement with the rear surface 129 of the bow body 113 at the bow grip 131, to fix the stud 143 securely in place on the bow grip 131 along the slot 143 extending through the bow grip 131 and to fix the spherical knob 139 of the ball and socket joint 137 at the second location along the bow grip 131.

The handle 133 has a front side 175 that faces the rear surface 129 of the bow body 113, and a rear side 177 that faces away from a target when a user of the bow 111 aims an arrow being shot from the bow 111 at the target. The handle 133 also has an upper end portion 179 and a lower end portion 181.

The bow 111 preferably also includes a first spring 183 mounted between the rear surface 129 of the bow body 113 and the front side 175 of the handle 133 at the upper end portion 179 of the handle 133, and a second spring 185 mounted between the rear surface 129 of the bow body 113 and the front side 175 of the handle 133 at the lower end portion 181 of the handle 133. The springs 183 and 185 stabilize the handle 133 (such as by tightening any looseness in the handle 133) and aid in vertically stabilizing the bow 111 when the bow string is drawn to keep the bow 111 oriented in a vertical position.

In use, the bows 11, 111 may be used by a bowhunter or an archer as any conventional bow is used, except that instead of engaging a conventional bow grip with the bowhunter/archer's hand when shooting an arrow from the bow, the bowhunter/archer's hand engages the handle 33, 133 with the hand engaging the rear side 77, 177 of the handle 33, 133. Accordingly, as the bow string of the bow 11, 111 is drawn, the pivot point 71, 171 establishes a single point force-wise at the bow grip 31, 131 via the ball and socket joint 37, 137 where the different directions of torque exerted onto the bow grip 31, 131 by the hand of an archer/bowhunter engaging the handle 33, 133 when shooting an arrow with the bow 11, 111 are focused into one small area and straight into the bow 11, 111, which allows the bow 11, 111 to naturally find a consistent resting point when drawn to a full draw.

The bows 11, 111 of the invention may be manufactured by (1) slotting the bow at the bow grip, such as by forming a slot 45 in the riser 15 at the bow grip 31 of the compound bow 11 shown in FIGS. 1-8, or by forming a slot 145 in the riser at the bow grip 131 of the recurve bow 111 represented in FIG. 9, or by forming a slot 145 in the bow body 113 at the bow grip 131 of a long bow 111 represented in FIG. 9, (2) installing the ball and socket joint 37, 137 (which preferably is pre-assembled to have the spherical knob 39, 139 secured in place within the spherical socket 41, 141 formed in the handle attachment member 57, 157) onto the bow 11, 111 at the bow grip 31, 131 by inserting the stud 43, 143 into and through the slot 43, 143 formed in the bow 11, 111 at the bow grip 31, 131 and securing the ball and socket joint 37, 137 securely to the bow 11, 111 by screwing the nut 49, 149 onto the threaded end portion 47, 147 of the stud 43, 143 and into tight engagement against the front surface of the bow 11, 111 at the bow grip 31, 131 (that is, for bow 11, into tight engagement against the front surface 27 of the riser 15 at the bow grip 31, and, for bow 111, into tight engagement against the front surface 127 of the riser or bow body 113 at the bow grip 131), thereby pulling a portion of the first end portion 53, 153 of the stud 43, 143 (such as the flange 51, 151) into tight engagement with the rear surface of the bow 11, 111 at the bow grip 31, 131 (that is, for bow 11, into tight engagement with the rear surface 29 of the riser 15 at the bow grip 31, and, for bow 111, into tight engagement with the rear surface 129 of the riser or bow body 113 at the bow grip 131), (3) installing the handle body 55, 155 onto the handle attachment member 57, 157 by screwing at least one screw 65, 165 (and preferably two screws 65, 165) through the slot 63, 163 in the handle body 55, 155 and into the handle attachment member 57, 157 such that a portion 69, 169 of the handle body 55, 155 along the slot 63, 163 in the handle body 55, 155 is sandwiched between the screwhead 67, 167 of each screw 65, 165 and the handle attachment member 57, 157 to attach the handle body 55, 155 to the handle attachment member 57, 157, and (4) installing the stabilizing springs (first spring 83, 183 and the second spring 85, 185) onto the bow 11, 111 by mounting the first spring 83, 183 at one end to the rear surface of the bow 11, 111 at the bow grip 31, 131 (that is, for bow 11, mounting the first spring 83 to the rear surface 29 of the riser 15 at the bow grip 31, and, for bow 111, mounting the first spring 183 to the rear surface 129 of the riser or bow body 113 at the bow grip 131) and at its other end to the front side 75, 175 of the handle 33, 133 at the upper end portion 79, 179 of the handle 33, 133 (that is, for bow 11, mounting the first spring 83 at its other end to the front side 75 of the handle 33 at the upper end portion 79 of the handle 33, and, for bow 111, mounting the first spring 183 at its other end to the front side 175 of the handle 133 at the upper end portion 179 of the handle 133), and by mounting the second spring 85, 185 at one end to the rear surface of the bow 11, 111 at the bow grip 31, 131 (that is, for bow 11, mounting the second spring 85 to the rear surface 29 of the riser 15 at the bow grip 31, and, for bow 111, mounting the second spring 185 to the rear surface 129 of the riser or bow body 113 at the bow grip 131) and at its other end to the front side 75, 175 of the handle 33, 133 at the lower end portion 81, 181 of the handle 33, 133 (that is, for bow 11, mounting the second spring 85 at its other end to the front side 75 of the handle 33 at the lower end portion 81 of the handle 33, and, for bow 111, mounting the second spring 185 at its other end to the front side 175 of the handle 133 at the lower end portion 181 of the handle 133).

Preferably, the riser 15 and the limbs 19 and 21 of bow 11, and the bow body 113 (and any component parts thereof) of bow 111, as well as the components of handles 33, 133, are made from wood, fiberglass, plastic (e.g., PVC, ABS, hard plastics), hard rubber (e.g., Ebonite), composites (e.g., fiber-reinforced polymer (FRP) composites), metals, carbon fiber, and combinations thereof. The spherical knob 39, 139 and stud 43, 143 extending therefrom, as well as nut 49, 149, preferably are metal, such as stainless steel, but other hard materials (e.g., hard plastics and hard rubbers) may be used. Preferably, screws 65, 165 are metal, such as stainless steel.

The inventive bow may be any type of bow (such as a compound bow, a recurve bow, or a long bow) that has been modified in accordance with the invention, such that the bow includes a bow grip handle (such as handle 33, handle 133, or the like) that is pivotally mounted on the bow for engaging a hand of a bowhunter or an archer when a bowhunter or an archer is shooting an arrow with the bow.

The invention provides a bow grip that highly reduces adverse effects of torquing forces applied to the bow grip when the bow is drawn to a full draw, effectively producing a substantially torque-less bow grip.

The invention claimed is:

1. A bow for bowhunting or archery, comprising a bow body, the bow body including a riser, the riser having a front surface that faces a target when a user of the bow aims an arrow being shot from the bow at the target, the riser having a rear surface that faces away from a target when a user of the bow aims an arrow being shot from the bow at the target, a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, and means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the riser, the ball and socket joint further including the spherical socket of the handle, the spherical socket receiving the spherical knob therein, thereby permitting the handle to pivot on the spherical knob, the bow grip having a slot formed therein extending from the front surface of the riser at the bow grip to the rear surface of the riser at the bow grip, the ball and socket joint further including a stud extending from the spherical knob and through the slot, the stud having a threaded end portion, and a nut sized to be threaded onto the threaded end portion of the stud to fix the stud securely in place in the slot, the handle including a handle body, a handle attachment member in which the spherical socket is located, the handle attachment member having a length, and attachment means for attaching the handle body to the handle attachment member, the handle having a pivot point over which the handle pivots, the pivot point corresponding to where the handle connects to the ball and socket joint, and the bow further including adjustment means for adjusting where the pivot point is located along the bow grip, the handle body having a recess formed therein along which the handle attachment member may be positioned, the recess having a length greater than the length of the handle attachment member, the attachment means including a slot formed in and extending through the handle body, a screw having a screw head, the screw being adapted to extend through the slot in the handle body and into the handle attachment member with a portion of the handle body along the slot in the handle body being sandwiched between the screw head and the handle attachment member to attach the handle body to the handle attachment member, the adjustment means comprising a combination of the recess in the handle body, the slot formed in and extending through the handle body, and the slot formed in and extending through the riser at the bow grip, said combination permitting the ball and socket joint to be positioned at any chosen location along the bow grip by sliding the handle attachment member along the recess in the handle body while sliding the stud along the slot extending through the bow grip, thereby permitting the pivot point of the handle to be moved to any chosen location along the bow grip.

2. The bow of claim 1, the adjustment means further including the screw securing the handle attachment member to the handle body by being extended through the slot in the handle body and into the handle attachment member with a portion of the handle body along the slot in the handle body being sandwiched between the screw head and the handle attachment member after the handle attachment member has been positioned along the recess in the handle body to position the ball and socket joint at a chosen location on the bow grip, and the nut securely fixing the stud in place in the slot formed in and extending through the riser at the bow grip by being threaded onto the threaded end portion of the stud until pressing securely against the riser at the front surface of the riser after the stud has been positioned along the slot extending through the bow grip to position the ball and socket joint at a chosen location along the bow grip.

3. A method of adjusting where the pivot point is located along the bow grip of the bow of claim 1, comprising the steps of untightening the nut on the threaded end portion of the stud, untightening the screw of the attachment means to permit the handle attachment member to slid along the recess in the handle body, sliding the handle attachment member along the recess in the handle body while sliding the stud along the slot extending through the bow grip until the ball and socket joint is re-positioned from a first location along the bow grip to a second location along the bow grip, the second location being where a user of the bow wishes the pivot point of the handle to be reset, screwing the screw through the slot into the handle body and into the handle attachment member so that a portion of the handle body along the slot in the handle body is sandwiched between the screw head of the screw and the handle attachment member to fix the socket of the ball and socket joint at the second location along the bow grip, and tightening the nut on the threaded end portion of the stud to fix the stud securely in place on the bow grip along the slot extending through the bow grip and to fix the spherical knob of the ball and socket joint at the second location along the bow grip.

4. A bow for bowhunting or archery, comprising a bow body, the bow body including a riser, the riser having a front surface that faces a target when a user of the bow aims an arrow being shot from the bow at the target, the riser having a rear surface that faces away from a target when a user of the bow aims an arrow being shot from the bow at the target, and a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, the handle having a front surface that faces the rear surface of the riser, the handle having an upper end portion and a lower end portion, and the bow further including a first spring mounted between the rear surface of the riser and the front surface of the handle at the upper end portion of the handle for stabilizing the handle, and a second spring mounted between the rear surface of the riser and the front surface of the handle at the lower end portion of the handle for stabilizing the handle.

5. A bow for bowhunting or archery, comprising a first end portion and a second end portion between which a bow string may be secured, a bow grip positioned along the bow between the first and second end portions for engaging a hand of a user of the bow when shooting an arrow with the bow, the bow having a front surface that faces a target when a user of the bow aims an arrow being shot from the bow at a target, the bow having a rear surface that faces away from a target when a user of the bow aims an arrow being shot from the bow at the target, the bow grip including a handle pivotally mounted thereto, the handle being pivotally mounted over the rear surface of the bow, and means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the bow, the ball and socket joint further including the spherical socket of the handle, the spherical socket receiving the spherical knob therein, thereby permitting the handle to pivot on the spherical knob, the bow grip having a slot formed therein extending from the front surface of the bow at the bow grip to the rear surface of the bow at the bow grip, the ball and socket joint further including a stud extending from the spherical knob and through the slot, the stud having a threaded end portion, and a nut sized to be threaded onto the threaded end portion of the stud to fix the stud securely in place in the slot, the handle including a handle body, a handle attachment member in which the spherical socket is located, the handle attachment member having a length, and attachment means for attaching the handle body to the handle attachment member, the handle having a pivot point over which the handle pivots, the pivot point corresponding to where the handle connects to the ball and socket joint, and the bow further including adjustment means for adjusting where the pivot point is located along the bow grip, the handle body having a recess formed therein along which the handle attachment member may be positioned, the recess having a length greater than the length of the handle attachment member, the attachment means including a slot formed in and extending through the handle body, a screw having a screw head, the screw being adapted to extend through the slot in the handle body and into the handle attachment member with a portion of the handle body along the slot in the handle body being sandwiched between the screw head and the handle attachment member to attach the handle body to the handle attachment member, the adjustment means comprising a combination of the recess in the handle body, the slot formed in and extending through the handle body, and the slot formed in and extending through the bow at the bow grip, said combination permitting the ball and socket joint to be positioned at any chosen location along the bow grip by sliding the handle attachment member along the recess in the handle body while sliding the stud along the slot extending through the bow grip, thereby permitting the pivot point of the handle to be moved to any chosen location along the bow grip.

6. The bow of claim 5, the adjustment means further including the screw securing the handle attachment member to the handle body by being extended through the slot in the handle body and into the handle attachment member with a portion of the handle body along the slot in the handle body being sandwiched between the screw head and the handle attachment member after the handle attachment member has been positioned along the recess in the handle body to position the ball and socket joint at a chosen location on the bow grip, and the nut securely fixing the stud in place in the slot formed in and extending through the bow at the bow grip by being threaded onto the threaded end portion of the stud until pressing securely against the bow at the front surface of the bow after the stud has been positioned along the slot extending through the bow grip to position the ball and socket joint at a chosen location along the bow grip.

7. A method of adjusting where the pivot point is located along the bow grip of the bow of claim 5, comprising the steps of untightening the nut on the threaded end portion of the stud, untightening the screw of the attachment means to permit the handle attachment member to slide along the recess in the handle body, sliding the handle attachment member along the recess in the handle body while sliding the stud along the slot extending through the bow grip until the ball and socket joint is re positioned from a first location along the bow grip to a second location along the bow grip, the second location being where a user of the bow wishes the pivot point of the handle to be reset, screwing the screw through the slot into the handle body and into the handle attachment member so that a portion of the handle body along the slot in the handle body is sandwiched between the screw head of the screw and the handle attachment member to fix the socket of the ball and socket joint at the second location along the bow grip, and tightening the nut on the threaded end of the stud to fix the stud securely in place in the slot extending through the bow grip and to fix the spherical knob of the ball and socket joint at the second location along the bow grip.

8. A bow for bowhunting or archery, comprising a first end portion and a second end portion between which a bow string may be secured, a bow grip positioned along the bow between the first and second end portions for engaging a hand of a user of the bow when shooting an arrow with the bow, the bow having a front surface that faces a target when a user of the bow aims an arrow being shot from the bow at a target, the bow having a rear surface that faces away from a target when a user of the bow aims an arrow being shot from the bow at the target, the bow grip including a handle pivotally mounted thereto, the handle being pivotally mounted over the rear surface of the bow, and the handle having a front surface that faces the rear surface of the bow, the handle having an upper end portion and a lower end portion, and the bow further including a first spring mounted between the rear surface of the bow and the front surface of the handle at the upper end portion of the handle for stabilizing the handle, and a second spring mounted between the rear surface of the bow and the front surface of the handle at the lower end portion of the handle for stabilizing the handle.

9. A bow for bowhunting or archery, comprising a bow body, the bow body including a riser, the riser having a front surface that faces a target when a user of the bow aims an arrow being shot from the bow at the target, the riser having a rear surface that faces away from a target when a user of the bow aims an arrow being shot from the bow at the target, a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the riser, the ball and socket joint further including the spherical socket of the handle, the spherical socket receiving the spherical knob therein, thereby permitting the handle to pivot on the spherical knob, the ball and socket joint further including a stud, the stud extending from the spherical knob and extending through a slot formed in the bow grip, the stud having a width measured perpendicularly across its axial centerline, the slot having a depth, a width, and a length, the depth of the slot extending completely through the bow grip from the front surface of the riser at the bow grip to the rear surface of the riser at the bow grip, the width of the slot extending partially across the riser in a horizontal direction, and the length of the slot extending partially across the riser in a vertical direction, the width of the slot being substantially the same throughout the entire width of the slot and the length of the slot being substantially the same throughout the entire length of the slot, the length of the slot being longer than the width of the slot, the length of the slot being longer than the width of the stud, and the slot being configured to permit the stud of the ball and socket joint to be slid anywhere along the length of the slot before the stud is fixed securely in place on the bow grip along the slot, thereby permitting the handle that is pivotally mounted on the spherical knob that extends from the stud to be moved to any chosen location along the bow grip, and the stud having a threaded end portion, and a nut sized to be threaded onto the threaded end portion of the stud to fix the stud securely in place in the slot.

10. The bow of claim 9, the handle including a handle body, a handle attachment member in which the spherical socket is located, the handle attachment member having a length, and attachment means for attaching the handle body to the handle attachment member, the handle having a pivot point over which the handle pivots, the pivot point corresponding to where the handle connects to the ball and socket joint, and the bow further including adjustment means for adjusting where the pivot point is located along the bow grip, the handle body having a recess formed therein along which the handle attachment member may be positioned, the recess having a length greater than the length of the handle attachment member, the attachment means including a slot formed in and extending through the handle body, a screw having a screw head, the screw being adapted to extend through the slot in the handle body and into the handle attachment member with a portion of the handle body adjacent to each side of the slot in the handle body being sandwiched between the screw head and the handle attachment member to attach the handle body to the handle attachment member, so as to position the ball and socket joint at any chosen location in the handle body, the any chosen location being any location along the recess in the handle body that the spherical socket may be positioned in the recess as the handle attachment member is slid along the recess in the handle body, the adjustment means comprising a combination of the recess in the handle body, the slot formed in and extending through the handle body, and the slot formed in and extending through the riser at the bow grip, said combination permitting the ball and socket joint to be positioned at any chosen location along the bow grip by sliding the handle attachment member along the recess in the handle body while sliding the stud along the slot extending through the bow grip, thereby permitting the pivot point of the handle to be moved to any chosen location along the bow grip.

11. The bow of claim 10, the adjustment means further including the screw securing the handle attachment member to the handle body by being extended through the slot in the handle body and into the handle attachment member with a portion of the handle body adjacent to each side of the slot in the handle body being sandwiched between the screw head and the handle attachment member after the handle attachment member has been positioned along the recess in the handle body to position the ball and socket joint at a chosen location on the bow grip, and the nut securely fixing the stud in place in the slot formed in and extending through the riser at the bow grip by being threaded onto the threaded end portion of the stud until pressing securely against the riser at the front surface of the riser after the stud has been positioned along the slot extending through the bow grip to position the ball and socket joint at a chosen location along the bow grip.

12. The bow of claim 11, the handle having a front surface that faces the rear surface of the riser, the handle having an upper end portion and a lower end portion, the bow further including a first spring mounted between the rear surface of the riser and the front surface of the handle at the upper end portion of the handle for stabilizing the handle, and a second spring mounted between the rear surface of the riser and the front surface of the handle at the lower end portion of the handle for stabilizing the handle.

13. The bow of claim 11, the handle having a front surface that faces the rear surface of the riser, the bow further including a stabilizing member positioned between the rear surface of the riser and the front surface of the handle for stabilizing the handle.

14. A method of adjusting where the pivot point is located along the bow grip of the bow of claim 10, comprising the steps of untightening the nut on the threaded end portion of the stud, untightening the screw of the attachment means to permit the handle attachment member to slide along the recess in the handle body, sliding the handle attachment member along the recess in the handle body while sliding the stud along the slot extending through the bow grip until the ball and socket joint is re-positioned from a first location along the bow grip to a second location along the bow grip, the second location being where a user of the bow wishes the pivot point of the handle to be reset, screwing the screw through the slot into the handle body and into the handle attachment member so that a portion of the handle body adjacent to each side of the slot in the handle body is sandwiched between the screw head of the screw and the handle attachment member to fix the socket of the ball and socket joint at the second location along the bow grip, and tightening the nut on the threaded end portion of the stud to fix the stud securely in place on the bow grip along the slot extending through the bow grip and to fix the spherical knob of the ball and socket joint at the second location along the bow grip.

15. A bow for bowhunting or archery, comprising a bow body, the bow body including a riser, the riser having a front surface that faces a target when a user of the bow aims an arrow being shot from the bow at the target, the riser having a rear surface that faces away from a target when a user of the bow aims an arrow being shot from the bow at the target, a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the riser, the ball and socket joint further including the spherical socket of the handle, the spherical socket receiving the spherical knob therein, thereby permitting the handle to pivot on the spherical knob, the ball and socket joint further including a stud, the stud extending from the spherical knob and extending through a slot formed in the bow grip, the stud having a width measured perpendicularly across its axial centerline, the slot having a depth, a width, and a length, the depth of the slot extending completely through the bow grip from the front surface of the riser at the bow grip to the rear surface of the riser at the bow grip, the width of the slot extending partially across the riser in a horizontal direction, and the length of the slot extending partially across the riser in a vertical direction, the width of the slot being substantially the same throughout the entire width of the slot and the length of the slot being substantially the same throughout the entire length of the slot, the length of the slot being longer than the width of the slot, the length of the slot being longer than the width of the stud, and the slot being configured to permit the stud of the ball and socket joint to be slid anywhere along the length of the slot before the stud is fixed securely in place on the bow grip along the slot, thereby permitting the handle that is pivotally mounted on the spherical knob that extends from the stud to be moved to any chosen location along the bow grip, and the stud having an end portion extending from the slot at the front surface of the riser of the bow grip, and a securing member positioned on the end portion of the stud for fixing the stud securely in place in the slot.

16. The bow of claim 15, the handle including a handle body, a handle attachment member in which the spherical socket is located, the handle attachment member having a length, and attachment means for attaching the handle body to the handle attachment member, the handle having a pivot point over which the handle pivots, the pivot point corresponding to where the handle connects to the ball and socket joint, and the bow further including adjustment means for adjusting where the pivot point is located along the bow grip, the handle body having a recess formed therein along which the handle attachment member may be positioned, the recess having a length greater than the length of the handle attachment member, the attachment means including a slot formed in and extending through the handle body, a screw having a screw head, the screw being adapted to extend through the slot in the handle body and into the handle attachment member with a portion of the handle body adjacent to each side of the slot in the handle body being sandwiched between the screw head and the handle attachment member to attach the handle body to the handle attachment member, so as to position the ball and socket joint at any chosen location in the handle body, the any chosen location being any location along the recess in the handle body that the spherical socket may be positioned in the recess as the handle attachment member is slid along the recess in the handle body, the adjustment means comprising a combination of the recess in the handle body, the slot formed in and extending through the handle body, and the slot formed in and extending through the riser at the bow grip, said combination permitting the ball and socket joint to be positioned at any chosen location along the bow grip by sliding the handle attachment member along the recess in the handle body while sliding the stud along the slot extending through the bow grip, thereby permitting the pivot point of the handle to be moved to any chosen location along the bow grip.

17. The bow of claim 16, the adjustment means further including the screw securing the handle attachment member to the handle body by being extended through the slot in the handle body and into the handle attachment member with a portion of the handle body adjacent to each side of the slot in the handle body being sandwiched between the screw head and the handle attachment member after the handle attachment member has been positioned along the recess in the handle body to position the ball and socket joint at a chosen location on the bow grip, and the securing member securely fixing the stud in place in the slot formed in and extending through the riser at the bow grip by pressing securely against the riser at the front surface of the riser after the stud has been positioned along the slot extending through the bow grip to position the ball and socket joint at a chosen location along the bow grip.

18. The bow of claim 17, the handle having a front surface that faces the rear surface of the riser, the handle having an upper end portion and a lower end portion, the bow further including a first spring mounted between the rear surface of the riser and the front surface of the handle at the upper end portion of the handle for stabilizing the handle, and a second spring mounted between the rear surface of the riser and the front surface of the handle at the lower end portion of the handle for stabilizing the handle.

19. The bow of claim 17, the handle having a front surface that faces the rear surface of the riser, the bow further including a stabilizing member positioned between the rear surface of the riser and the front surface of the handle for stabilizing the handle.

20. A method of adjusting where the pivot point is located along the bow grip of the bow of claim 16, comprising the steps of untightening the securing member on the end portion of the stud from pressing securely against the riser at the front surface of the riser, untightening the screw of the attachment means to permit the handle attachment member to slide along the recess in the handle body, sliding the handle attachment member along the recess in the handle body while sliding the stud along the slot extending through the bow grip until the ball and socket joint is re-positioned from a first location along the bow grip to a second location along the bow grip, the second location being where a user of the bow wishes the pivot point of the handle to be reset, screwing the screw through the slot into the handle body and into the handle attachment member so that a portion of the handle body adjacent to each side of the slot in the handle body is sandwiched between the screw head of the screw and the handle attachment member to fix the socket of the ball and socket joint at the second location along the bow grip, and fixing the stud securely in place on the bow grip along the slot extending through the bow grip by having the securing member press securely against the riser at the front surface of the riser after the stud has been repositioned along the slot extending through the bow grip and to fix the spherical knob of the ball and socket joint at the second location along the bow grip.

21. A bow for bowhunting or archery, comprising a bow body, the bow body including a riser, the riser having a front surface that faces a target when a user of the bow aims an arrow being shot from the bow at the target, the riser having a rear surface that faces away from a target when a user of the bow aims an arrow being shot from the bow at the target, a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, and means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the riser, the ball and socket joint further including the spherical socket of the handle, the spherical socket receiving the spherical knob therein, thereby permitting the handle to pivot on the spherical knob, the handle including a handle body, a handle attachment member in which the spherical socket is located, the handle attachment member having a length, and attachment means for attaching the handle body to the handle attachment member, the handle body having a recess formed therein in which and along which the handle attachment member may be positioned, the handle body having a front surface that faces the rear surface of the riser and a rear surface that faces away from a target when a user of the bow aims an arrow being shot from the bow at the target, the recess having a length greater than the length of the handle attachment member to permit the handle attachment member to be slid along the recess to any chosen location along the recess before the handle body is attached to the handle attachment member, and the attachment means including a slot formed in and extending completely through the handle body and extending partially across the handle body, the slot having a depth, a width, and a length, the depth of the slot extending completely through the handle body from the front surface of the handle body to the rear surface of the handle body, the width of the slot extending partially across the handle body in a horizontal direction, and the length of the slot extending partially across the handle body in a vertical direction, the width of the slot being substantially the same throughout the entire width of the slot and the length of the slot being substantially the same throughout the entire length of the slot, the length of the slot being longer than the width of the slot, and the slot being in direct contact with the recess, and a screw having a screw head, the screw extending through the slot in the handle body to engage a portion of the handle attachment member positioned in the recess of the handle body after the handle attachment member has been positioned in a chosen location along the length of the recess, with the portion of the handle attachment member engaged by the screw being in the recess of the handle body, and with the screw head of the screw abutting against a portion of the rear surface of the handle body adjacent to each side of the slot in the handle body, and with a portion of the handle body adjacent to each side of the slot in the handle body being sandwiched between the screw head and the handle attachment member, to attach the handle body to the handle attachment member, so as to position the ball and socket joint at any chosen location in the handle body, the any chosen location being any location along the recess in the handle body that the handle attachment member may be slid in the recess in the handle body.

22. A bow for bowhunting or archery, comprising a bow body, the bow body including a riser, the riser having a front surface that faces a target when a user of the bow aims an arrow being shot from the bow at the target, the riser having a rear surface that faces away from a target when a user of the bow aims an arrow being shot from the bow at the target, and a bow grip for engaging a hand of a user of the bow when shooting an arrow with the bow, the bow grip being located along and comprising a portion of the riser, the bow grip including a handle pivotally mounted thereto, the handle being pivotally mounted over the rear surface of the riser, the handle having a front surface that faces the rear surface of the riser, and the bow further including a stabilizing member positioned between the rear surface of the riser and the front surface of the handle for stabilizing the handle.

23. A bow for bowhunting or archery, comprising a first end portion and a second end portion between which a bow string may be secured, a bow grip positioned along the bow between the first and second end portions for engaging a hand of a user of the bow when shooting an arrow with the bow, the bow having a front surface that faces a target when a user of the bow aims an arrow being shot from the bow at a target, the bow having a rear surface that faces away from a target when a user of the bow aims an arrow being shot from the bow at the target, the bow grip including a handle pivotally mounted thereto, the handle being pivotally mounted over the rear surface of the bow, means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the bow, the ball and socket joint further including the spherical socket of the handle, the spherical socket receiving the spherical knob therein, thereby permitting the handle to pivot on the spherical knob, the ball and socket joint further including a stud, the stud extending from the spherical knob and extending through a slot formed in the bow grip, the stud having a width measured perpendicularly across its axial centerline, the slot having a depth, a width, and a length, the depth of the slot extending completely through the bow grip from the front surface of the bow at the bow grip to the rear surface of the bow at the bow grip, the width of the slot extending partially across the bow in a horizontal direction, and the length of the slot extending partially across the bow in a vertical direction, the width of the slot being substantially the same throughout the entire width of the slot and the length of the slot being substantially the same throughout the entire length of the slot, the length of the slot being longer than the width of the slot, the length of the slot being longer than the width of the stud, and the slot being configured to permit the stud of the ball and socket joint to be slid anywhere along the length of the slot before the stud is fixed securely in place on the bow grip along the slot, thereby permitting the handle that is pivotally mounted on the spherical knob that extends from the stud to be moved to any chosen location along the bow grip, and the stud having a threaded end portion, and a nut sized to be threaded onto the threaded end portion of the stud to fix the stud securely in place in the slot.

24. The bow of claim 23, the handle including a handle body, a handle attachment member in which the spherical socket is located, the handle attachment member having a length, and attachment means for attaching the handle body to the handle attachment member, the handle having a pivot point over which the handle pivots, the pivot point corresponding to where the handle connects to the ball and socket joint, and the bow further including adjustment means for adjusting where the pivot point is located along the bow grip, the handle body having a recess formed therein along which the handle attachment member may be positioned, the recess having a length greater than the length of the handle attachment member, the attachment means including a slot formed in and extending through the handle body, a screw having a screw head, the screw being adapted to extend through the slot in the handle body and into the handle attachment member with a portion of the handle body adjacent to each side of the slot in the handle body being sandwiched between the screw head and the handle attachment member to attach the handle body to the handle attachment member, so as to position the ball and socket joint at any chosen location in the handle body, the any chosen location being any location along the recess in the handle body that the spherical socket may be positioned in the recess as the handle attachment member is slid along the recess in the handle body, the adjustment means comprising a combination of the recess in the handle body, the slot formed in and extending through the handle body, and the slot formed in and extending through the bow at the bow grip, said combination permitting the ball and socket joint to be positioned at any chosen location along the bow grip by sliding the handle attachment member along the recess in the handle body while sliding the stud along the slot extending through the bow grip, thereby permitting the pivot point of the handle to be moved to any chosen location along the bow grip.

25. The bow of claim 24, the adjustment means further including the screw securing the handle attachment member to the handle body by being extended through the slot in the handle body and into the handle attachment member with a portion of the handle body adjacent to each side of the slot in the handle body being sandwiched between the screw head and the handle attachment member after the handle attachment member has been positioned along the recess in the handle body to position the ball and socket joint at a chosen location on the bow grip, and the nut securely fixing the stud in place in the slot formed in and extending through the bow at the bow grip by being threaded onto the threaded end portion of the stud until pressing securely against the bow at the front surface of the bow after the stud has been positioned along the slot extending through the bow grip to position the ball and socket joint at a chosen location along the bow grip.

26. The bow of claim 25, the handle having a front surface that faces the rear surface of the bow, the handle having an upper end portion and a lower end portion, the bow further including a first spring mounted between the rear surface of the bow and the front surface of the handle at the upper end portion of the handle for stabilizing the handle, and a second spring mounted between the rear surface of the bow and the front surface of the handle at the lower end portion of the handle for stabilizing the handle.

27. The bow of claim 25, the handle having a front surface that faces the rear surface of the bow, the bow further including a stabilizing member positioned between the rear surface of the bow and the front surface of the handle for stabilizing the handle.

28. A method of adjusting where the pivot point is located along the bow grip of the bow of claim 24, comprising the steps of untightening the nut on the threaded end portion of the stud, untightening the screw of the attachment means to permit the handle attachment member to slide along the recess in the handle body, sliding the handle attachment member along the recess in the handle body while sliding the stud along the slot extending through the bow grip until the ball and socket joint is re-positioned from a first location along the bow grip to a second location along the bow grip, the second location being where a user of the bow wishes the pivot point of the handle to be reset, screwing the screw through the slot into the handle body and into the handle attachment member so that a portion of the handle body adjacent to each side of the slot in the handle body is sandwiched between the screw head of the screw and the handle attachment member to fix the socket of the ball and socket joint at the second location along the bow grip, and tightening the nut on the threaded end portion of the stud to fix the stud securely in place on the bow grip along the slot extending through the bow grip and to fix the spherical knob of the ball and socket joint at the second location along the bow grip.

29. A bow for bowhunting or archery, comprising a first end portion and a second end portion between which a bow string may be secured, a bow grip positioned along the bow between the first and second end portions for engaging a hand of a user of the bow when shooting an arrow with the bow, the bow having a front surface that faces a target when a user of the bow aims an arrow being shot from the bow at a target, the bow having a rear surface that faces away from a target when a user of the bow aims an arrow being shot from the bow at the target, the bow grip including a handle pivotally mounted thereto, the handle being pivotally mounted over the rear surface of the bow, and means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the bow, the ball and socket joint further including the spherical socket of the handle, the spherical socket receiving the spherical knob therein, thereby permitting the handle to pivot on the spherical knob, the ball and socket joint further including a stud, the stud extending from the spherical knob and extending through a slot formed in the bow grip, the stud having a width measured perpendicularly across its axial centerline, the slot having a depth, a width, and a length, the depth of the slot extending completely through the bow grip from the front surface of the bow at the bow grip to the rear surface of the bow at the bow grip, the width of the slot extending partially across the bow in a horizontal direction, and the length of the slot extending partially across the bow in a vertical direction, the width of the slot being substantially the same throughout the entire width of the slot and the length of the slot being substantially the same throughout the entire length of the slot, the length of the slot being longer than the width of the slot, the length of the slot being longer than the width of the stud, and the slot being configured to permit the stud of the ball and socket joint to be slid anywhere along the length of the slot before the stud is fixed securely in place on the bow grip along the slot, thereby permitting the handle that is pivotally mounted on the spherical knob that extends from the stud to be moved to any chosen location along the bow grip, and the stud having an end portion extending from the slot at the front surface of the bow of the bow grip, and a securing member positioned on the end portion of the stud for fixing the stud securely in place in the slot.

30. The bow of claim 29, the handle including a handle body, a handle attachment member in which the spherical socket is located, the handle attachment member having a length, and attachment means for attaching the handle body to the handle attachment member, the handle having a pivot point over which the handle pivots, the pivot point corresponding to where the handle connects to the ball and socket joint, and the bow further including adjustment means for adjusting where the pivot point is located along the bow grip, the handle body having a recess formed therein along which the handle attachment member may be positioned, the recess having a length greater than the length of the handle attachment member, the attachment means including a slot formed in and extending through the handle body, a screw having a screw head, the screw being adapted to extend through the slot in the handle body and into the handle attachment member with a portion of the handle body adjacent to each side of the slot in the handle body being sandwiched between the screw head and the handle attachment member to attach the handle body to the handle attachment member, so as to position the ball and socket joint at any chosen location in the handle body, the any chosen location being any location along the recess in the handle body that the spherical socket may be positioned in the recess as the handle attachment member is slid along the recess in the handle body, the adjustment means comprising a combination of the recess in the handle body, the slot formed in and extending through the handle body, and the slot formed in and extending through the bow at the bow grip, said combination permitting the ball and socket joint to be positioned at any chosen location along the bow grip by sliding the handle attachment member along the recess in the handle body while sliding the stud along the slot extending through the bow grip, thereby permitting the pivot point of the handle to be moved to any chosen location along the bow grip.

31. The bow of claim 30, the adjustment means further including the screw securing the handle attachment member to the handle body by being extended through the slot in the handle body and into the handle attachment member with a portion of the handle body adjacent to each side of the slot in the handle body being sandwiched between the screw head and the handle attachment member after the handle attachment member has been positioned along the recess in the handle body to position the ball and socket joint at a chosen location on the bow grip, and the securing member securely fixing the stud in place in the slot formed in and extending through the bow at the bow grip by pressing securely against the bow at the front surface of the bow after the stud has been positioned along the slot extending through the bow grip to position the ball and socket joint at a chosen location along the bow grip.

32. The bow of claim 31, the handle having a front surface that faces the rear surface of the bow, the handle having an upper end portion and a lower end portion, the bow further including a first spring mounted between the rear surface of the bow and the front surface of the handle at the upper end portion of the handle for stabilizing the handle, and a second spring mounted between the rear surface of the bow and the front surface of the handle at the lower end portion of the handle for stabilizing the handle.

33. The bow of claim 31, the handle having a front surface that faces the rear surface of the bow, the bow further including a stabilizing member positioned between the rear surface of the bow and the front surface of the handle for stabilizing the handle.

34. A method of adjusting where the pivot point is located along the bow grip of the bow of claim 30, comprising the steps of untightening the securing member on the end portion of the stud from pressing securely against the bow at the front surface of the bow, untightening the screw of the attachment means to permit the handle attachment member to slide along the recess in the handle body, sliding the handle attachment member along the recess in the handle body while sliding the stud along the slot extending through the bow grip until the ball and socket joint is re-positioned from a first location along the bow grip to a second location along the bow grip, the second location being where a user of the bow wishes the pivot point of the handle to be reset, screwing the screw through the slot into the handle body and into the handle attachment member so that a portion of the handle body adjacent to each side of the slot in the handle body is sandwiched between the screw head of the screw and the handle attachment member to fix the socket of the ball and socket joint at the second location along the bow grip, and fixing the stud securely in place on the bow grip along the slot extending through the bow grip by having the securing member press securely against the bow at the front surface of the bow after the stud has been repositioned along the slot extending through the bow grip and to fix the spherical knob of the ball and socket joint at the second location along the bow grip.

35. A bow for bowhunting or archery, comprising a first end portion and a second end portion between which a bow string may be secured, a bow grip positioned along the bow between the first and second end portions for engaging a hand of a user of the bow when shooting an arrow with the bow, the bow having a front surface that faces a target when a user of the bow aims an arrow being shot from the bow at a target, the bow having a rear surface that faces away from a target when a user of the bow aims an arrow being shot from the bow at the target, the bow grip including a handle pivotally mounted thereto, the handle being pivotally mounted over the rear surface of the bow, and means for pivotally mounting the handle onto the bow grip, the means for pivotally mounting the handle onto the bow grip comprising a ball and socket joint, the handle having a spherical socket, and the ball and socket joint including a spherical knob mounted to the bow grip and extending rearwardly away from the rear surface of the bow, the ball and socket joint further including the spherical socket of the handle, the spherical socket receiving the spherical knob therein, thereby permitting the handle to pivot on the spherical knob, the handle including a handle body, a handle attachment member in which the spherical socket is located, the handle attachment member having a length, and attachment means for attaching the handle body to the handle attachment member, the handle body having a recess formed therein in which and along which the handle attachment member may be positioned, the handle body having a front surface that faces the rear surface of the bow and a rear surface that faces away from a target when a user of the bow aims an arrow being shot from the bow at the target, the recess having a length greater than the length of the handle attachment member to permit the handle attachment member to be slid along the recess to any chosen location along the recess before the handle body is attached to the handle attachment member, and the attachment means including a slot formed in and extending completely through the handle body and extending partially across the handle body, the slot having a depth, a width, and a length, the depth of the slot extending completely through the handle body from the front surface of the handle body to the rear surface of the handle body, the width of the slot extending partially across the handle body in a horizontal direction, and the length of the slot extending partially across the handle body in a vertical direction, the width of the slot being substantially the same throughout the entire width of the slot and the length of the slot being substantially the same throughout the entire length of the slot, the length of the slot being longer than the width of the slot, and the slot being in direct contact with the recess, and a screw having a screw head, the screw extending through the slot in the handle body to engage a portion of the handle attachment member positioned in the recess of the handle body after the handle attachment member has been positioned in a chosen location along the length of the recess, with the portion of the handle attachment member engaged by the screw being in the recess of the handle body, and with the screw head of the screw abutting against a portion of the rear surface of the handle body adjacent to each side of the slot in the handle body, and with a portion of the handle body adjacent to each side of the slot in the handle body being sandwiched between the screw head and the handle attachment member, to attach the handle body to the handle attachment member, so as to position the ball and socket joint at any chosen location in the handle body, the any chosen location being any location along the recess in the handle body that the handle attachment member may be slid in the recess in the handle body.

36. A bow for bowhunting or archery, comprising a first end portion and a second end portion between which a bow string may be secured, a bow grip positioned along the bow between the first and second end portions for engaging a hand of a user of the bow when shooting an arrow with the bow, the bow having a front surface that faces a target when a user of the bow aims an arrow being shot from the bow at a target, the bow having a rear surface that faces away from a target when a user of the bow aims an arrow being shot from the bow at the target, the bow grip including a handle pivotally mounted thereto, the handle being pivotally mounted over the rear surface of the bow, the handle having a front surface that faces the rear surface of the bow, and the bow further including a stabilizing member positioned between the rear surface of the bow and the front surface of the handle for stabilizing the handle.

* * * * *